US006123268A

United States Patent [19]

Chastine

[11] Patent Number: 6,123,268

[45] Date of Patent: Sep. 26, 2000

[54] ANGULARLY ADJUSTABLE NOZZLE

[75] Inventor: Christopher R. Chastine, Bethlehem, Ga.

[73] Assignee: Nordson Corporation, Westlake, Ohio

[21] Appl. No.: 09/304,781

[22] Filed: May 4, 1999

[51] Int. Cl.[7] ..... B05B 17/00; B05B 15/08; B05D 17/00

[52] U.S. Cl. ..... 239/1; 239/587.4; 285/261

[58] Field of Search ..... 239/1, 587.1, 587.4, 239/587.5, 587.6, 451; 285/261, 262, 263, 266

[56] References Cited

U.S. PATENT DOCUMENTS

| | | | |
|---|---|---|---|
| 2,195,811 | 4/1940 | Bramsen et al. | 299/150 |
| 2,535,873 | 12/1950 | Smith | 158/27.4 |
| 2,557,106 | 6/1951 | Hughes | 239/587.4 X |
| 2,573,904 | 11/1951 | Grossman | 239/587.4 X |
| 2,595,826 | 5/1952 | Winks et al. | 299/89 |
| 2,677,416 | 5/1954 | Smith | 158/27.4 |
| 3,004,588 | 10/1961 | Christenson | 158/27.4 |
| 3,332,580 | 7/1967 | Spencer et al. | 222/146 |
| 3,334,818 | 8/1967 | Moen | 239/428.5 |
| 3,543,332 | 12/1970 | Wagner et al. | 18/8 |
| 3,985,303 | 10/1976 | Steimle | 239/587.4 X |
| 4,469,248 | 9/1984 | Petrecca | 222/48 |
| 4,601,427 | 7/1986 | Trevathan et al. | 239/11 |
| 4,690,327 | 9/1987 | Takai et al. | 239/226 |
| 4,785,996 | 11/1988 | Ziecker et al. | 239/298 |
| 4,844,003 | 7/1989 | Slautterback et al. | 118/323 |
| 5,087,484 | 2/1992 | Stewart | 427/239 |
| 5,141,165 | 8/1992 | Sharpless et al. | 239/752 |
| 5,186,394 | 2/1993 | Tsuji | 239/587.4 |
| 5,197,673 | 3/1993 | Sullivan | 239/102.1 |
| 5,238,190 | 8/1993 | Herke | 239/298 |
| 5,353,447 | 10/1994 | Gravatt | 4/541.6 |
| 5,462,230 | 10/1995 | Van Ouwerkerk | 239/587.4 X |
| 5,507,534 | 4/1996 | Reifenberger et al. | 285/132 |
| 5,657,496 | 8/1997 | Corb et al. | 4/541.6 |
| 5,730,370 | 3/1998 | Bowen | 239/587.4 X |
| 5,887,757 | 3/1999 | Jenkins et al. | 222/146.2 |

OTHER PUBLICATIONS

Slautterback, *Slautterback Applicator Systems*, Brochure, Jul. 1992.

Slautterback Corproation, *Model E100™ Automatic Applicator Head*, Brochure, undated.

Nordson Corporation, *1994 Adhesives and Sealants Equipment Catalog*, Catalog.

*Primary Examiner*—Andres Kashnikow
*Assistant Examiner*—Sean P. O'Hanlon
*Attorney, Agent, or Firm*—Wood, Herron & Evans, L.L.P.

[57] ABSTRACT

A nozzle for dispensing adhesive or glue at one of a plurality of selected angles. The nozzle is particularly adapted for use with an adhesive dispenser. The nozzle includes a swivel nozzle member with a bore and a swivel adjustment surface. A seal member has a throughhole and a swivel adjustment surface and the throughhole is in fluid communication with the liquid discharge passage of the dispenser body. A retaining member having locked and unlocked positions holds the swivel adjustment surface of the seal member against the swivel adjustment surface of the swivel nozzle member. The swivel nozzle member is movable for selective adjustment when the retaining member is in the unlocked position to orient the bore of the swivel nozzle member in multiple transverse angles relative to the throughhole. Similarly, the swivel nozzle member is fixed against the selective adjustment when the retaining member is in the locked position.

11 Claims, 3 Drawing Sheets

ANGULARLY ADJUSTABLE NOZZLE

FIELD OF THE INVENTION

The present invention generally relates to apparatus for dispensing liquid and, more specifically, to angularly adjustable nozzles for dispensing liquids.

BACKGROUND OF THE INVENTION

Many types of dispensers have one or more nozzles from which a liquid is discharged onto a substrate. Nozzle designs vary according to the liquid application requirements, but generally a nozzle will have at least one discharge bore oriented at a fixed angle relative to the remainder of the dispensing apparatus. That is, the discharge bore is machined or otherwise formed in the nozzle such that the direction of the liquid discharge cannot be changed once the apparatus is fixed in place. Certain nozzles may have a plurality of discharge bores at different fixed angles relative to the remainder of the apparatus, depending on the liquid application requirements.

Nozzles for dispensing hot melt adhesive, for example, often have bores oriented at fixed angles to enable a specific pattern of adhesive to be applied to the substrate. Accordingly, when a different adhesive pattern is required, one or more nozzles must be replaced with other nozzles having appropriately oriented bores. Thus, dedicated nozzles must be stocked and installed as required by a new application. Changing nozzles to accommodate different application requirements has disadvantages associated with the changeover time and cost. For instance, several different nozzles must be kept on hand to satisfy the changing requirements of each liquid application. Additionally, time must be expended to change from one set of nozzles to another and this changeover time can be significant in large scale operations. Finally, it is not economically practical to manufacture numerous nozzle types and orientations to accommodate every possible need.

To alleviate problems such as those mentioned above, it would be desirable to provide a dispenser, such as a hot melt adhesive dispenser, having a nozzle in which the orientation of the discharge bore may be easily adjusted and locked at a desired angular position.

SUMMARY OF INVENTION

The present invention is generally directed to a nozzle for dispensing liquid, such as hot melt adhesive or glue, at selectively adjustable angles. More particularly, the nozzle is adjustable and lockable and adapted for use with a dispenser. The nozzle includes a swivel nozzle member with a bore and a swivel adjustment surface. A seal member includes a mating swivel adjustment surface and a throughhole in fluid communication with a liquid discharge passageway of the dispenser body. The seal member may be an integral part of the dispenser body, but is preferably a separate component in the nozzle. A retaining member has locked and unlocked positions and holds the swivel adjustment surface of the seal member against the swivel adjustment surface of the swivel nozzle member. The swivel nozzle member is movable for selective adjustment when the retaining member is in the unlocked position to orient the bore of the swivel nozzle member in any one of a plurality of angles relative to the throughhole and is fixed against adjustment when the retaining member is in the locked position with the bore oriented at a selected one of the plurality of angles.

Advantageously, the swivel nozzle member is substantially spherical and therefore angularly adjustable over a wide range of angles with the center of the swivel nozzle member generally defining a swivel or pivot point. Furthermore, the respective swivel adjustment surfaces may have different curvatures to form a gap between the two surfaces through which liquid communicates between the throughhole and the bore at the selected angular positions. The swivel adjustment surface of the seal member is preferably a recessed surface such that the bore of the swivel nozzle member remains in fluid communication with the throughhole in the seal member and the liquid discharge passageway of the dispenser body when oriented at the selected angular positions.

The retaining member preferably includes a threaded portion for securing the retaining member to a dispenser body and establishing the locked and unlocked positions. Accordingly, the swivel nozzle member is angularly adjustable when the retaining member is in the unlocked position and prevented from rotating when the retaining member is in the locked position.

In another embodiment, the swivel nozzle member has a plurality of pivotally connected pieces and each piece has a bore for discharging liquid. The pivotally connected pieces and bores are pivotally adjustable relative to each other and are locked in place simultaneously by the retaining member. The swivel nozzle member has two halves each pivotally connected for rotation relative to each other as well as for angular adjustment relative to the dispenser body.

A method of angularly adjusting and securing the swivel nozzle member to the dispenser body includes retaining the swivel nozzle member against the dispenser body in an unlocked position that allows fluid communication between the liquid discharge passageway of the dispenser body and the bore of the nozzle member. While in the unlocked position, the swivel nozzle member is moved or adjusted to direct the bore at a desired angular position relative to the liquid discharge passageway. The swivel nozzle member is then locked at the desired transverse angular position such that the swivel nozzle member is prevented from further angular adjustment.

The nozzle of the present invention provides several advantages over fixed angle nozzles. For instance, an installer can readily change the angle at which the liquid is discharged relative to the dispenser body. In addition, the swivel nozzle member can be infinitely adjusted between multiple extreme angular positions. Two independently adjustable nozzle pieces provide additional angular positions relative to the dispenser body. As such, the independently adjustable pieces provide increased spacing capabilities when applying liquid to a substrate.

Moreover, the nozzle of the present invention provides several advantages over other angularly adjustable nozzles. For instance, the nozzle may be moved to a desired angular position and then locked into place. Accordingly, the nozzle is not easily dislocated from the required angular position and assures continuous, precise application of hot melt adhesive, glue or other material to a substrate.

Various additional advantages, objects and features of the invention will become more readily apparent to those of ordinary skill in the art upon consideration of the following detailed description of the presently preferred embodiments taken in conjunction with the accompanying drawings.

DETAILED DESCRIPTION OF PREFERRED EMBODIMENTS

Figure 1:
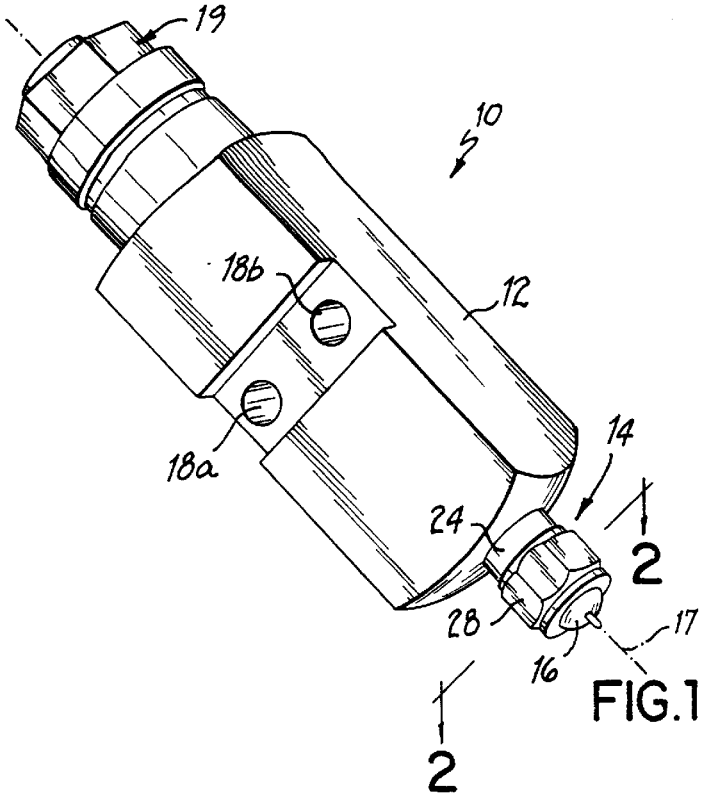
FIG. 1 is a perspective view of an angularly adjustable nozzle attached to the end of a liquid dispenser.
Figure 2:
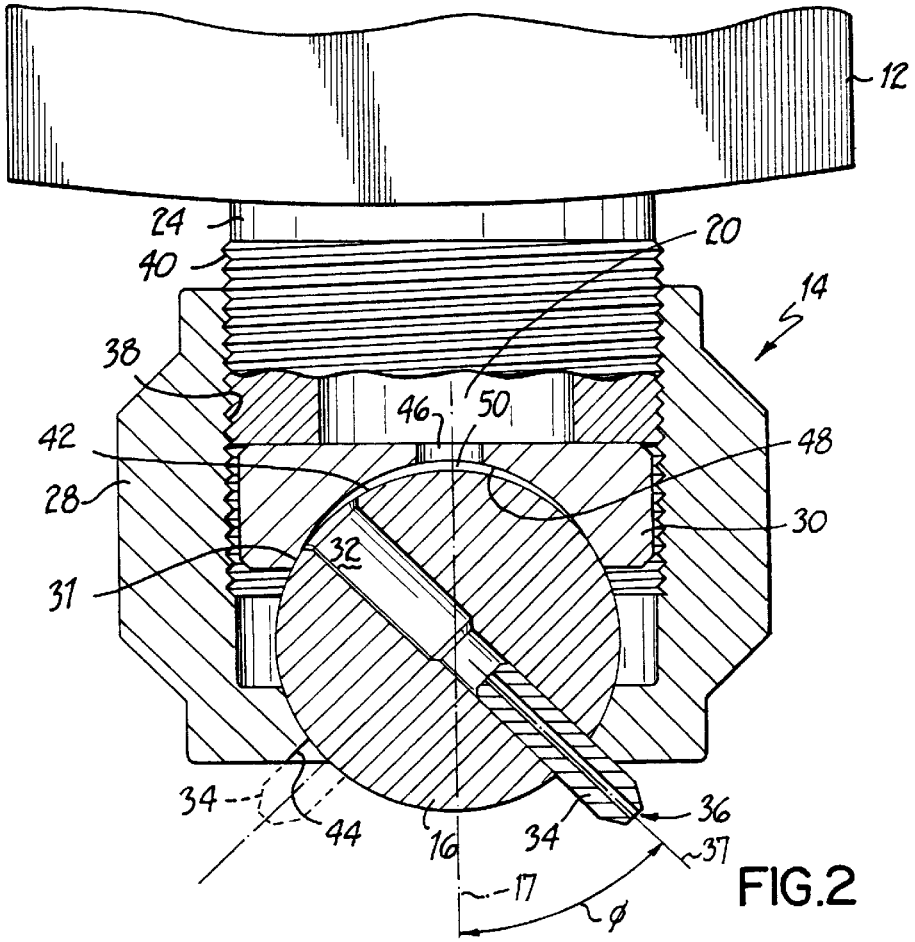
FIG. 2 is an enlarged partial cross-sectional view of the angularly adjustable nozzle of FIG. 1 taken along line 2—2 and showing the nozzle at one extreme angular position.

Referring first to FIGS. 1 and 2, a dispenser 10 includes a dispenser body 12 and an angularly adjustable nozzle 14 constructed in accordance with the principles of this invention. Dispenser 10 is specifically adapted for dispensing liquids, such as heated thermoplastic liquids or hot melt adhesives, but other liquid dispensers will benefit from the invention as well. Nozzle 14 includes a swivel nozzle member 16 that readily facilitates changing the angle of liquid discharge relative to a longitudinal axis 17 extending through the length of the dispenser 10. The inventive principles will be described with reference to only some of many possible embodiments of swivel nozzles falling within the scope of this invention.

Dispenser body 12 includes mounting holes 18*a*, 18*b* for mounting dispenser body 12 to a support structure, such as a heated manifold. One side of dispenser body 12 includes a spring return mechanism 19 operatively connected to an internal valve stem (not shown) mounted in a liquid discharge passageway 20. Spring return mechanism 19 closes the valve stem against an internal valve seat (not shown) to stop the flow of liquid through dispenser 10 in a known manner. Accordingly, dispenser body 12 and spring return mechanism 19 can serve as an on/off valve by moving the valve stem with respect to the valve seat disposed in liquid discharge passageway 20 internal to dispenser body 12. The valve stem may be pneumatically or electrically actuated to selectively dispense the liquid from liquid discharge passageway 20 to the attached nozzle 14.

Dispenser body 12 is only one of many possible dispenser bodies usable with nozzle 14 of this invention. Other types of dispensers, such as modules, guns, or manifolds may be used as well. Commercially available examples of pneumatically actuated dispenser bodies 12 are the H-200 and H-400 modules, both of which are available from Nordson Corporation, Westlake, Ohio.

Nozzle 14 attaches to a discharge end 24 of dispenser body 12 thereby coupling swivel nozzle member 16 in fluid communication with passageway 20 of dispenser body 12. Swivel nozzle member 16 is coupled to discharge end 24 of dispenser body 12 by a retaining member 28. In addition, nozzle 14 includes a seal member 30 held in sealing engagement between dispenser body 12 and swivel nozzle member 16 by retaining member 28. More particularly, seal member 30 engages swivel nozzle member 16 at a sealing line of contact 31 to create a fluid seal between seal member 30 and swivel nozzle member 16.

Although swivel nozzle member 16, seal member 30, and retaining member 28 can be formed of any material suitable to the desired application, these components are preferably made of brass for hot melt adhesive dispensing applications. In this regard, brass has advantageous thermal conductivity and strength properties. For increased durability, retaining member 28 is preferably coated with zinc.

Swivel nozzle member 16 has a bore 32 in fluid communication with liquid discharge passageway 20 of the dispenser body 12. A nozzle insert 34 with a tip 36 is press fit into bore 32 for discharging liquid received from liquid discharge passageway 20 of dispenser body 12. Although nozzle 14 of FIG. 2 shows swivel nozzle member 16 with only one bore 32, swivel nozzle member 16 could have a plurality of bores each in fluid communication with liquid discharge passageway 20.

Retaining member 28 preferably has a threaded portion 38 which engages a complimentary threaded portion 40 at discharge end 24 of dispenser body 12. As such, retaining member 28 can be selectively placed in locked or unlocked positions depending on how tightly retaining member 28 is threaded onto threaded portion 40. Additionally, swivel nozzle member 16 has a swivel adjustment surface 42 which is rounded to allow angular adjustment of swivel nozzle member 16 in multiple directions. More particularly, a reference axis 37 is coaxially aligned with the bore 32 and the nozzle insert 34 and forms an angle $\phi$ between the reference axis 37 and the longitudinal axis 17. When $\phi$ equals zero the longitudinal axis 17 and the reference axis 37 are coincident with one another. Advantageously, swivel nozzle member 16 is substantially spherical such that swivel nozzle member 16 is angularly adjustable over a predetermined range of angles $\phi$. Therefore, in accordance with the principles of the invention, swivel nozzle member 16 is angularly adjustable when retaining member 28 is in an unlocked position. Similarly, swivel nozzle member 16 is prevented from rotating when retaining member 28 is tightened into the locked position.

The maximum amount of angular adjustment is limited by nozzle insert 34 contacting opposite sides of a surrounding wall 44 of retaining member 28 as illustrated in FIG. 2. Preferably, swivel nozzle member 16 is configured to allow a range of adjustment with $\phi$ ranging from zero to about 60 degrees in all directions within surrounding wall 44. Accordingly, bore 32 remains in fluid communication with liquid discharge passageway 20 of dispenser body 12 when swivel nozzle member 16 is selectively positioned at any desired dispensing angle within these limits.

Seal member 30 includes a throughhole 46 which is in fluid communication with both liquid discharge passageway 20 of dispenser body 12 and bore 32 of swivel nozzle member 16. Seal member 30 allows swivel nozzle member 16 to be angularly adjusted in transverse directions relative to throughhole 46 when retaining member 28 is in the unlocked position and to fix the angular position when retaining member 28 is in the locked position. Although seal member 30 is a separate component of nozzle 14, seal member 30 could be an integral component of discharge end 24 of dispenser body 12 such that, for example, nozzle 14 comprises only swivel nozzle member 16 and retaining member 28.

Seal member 30 further includes a swivel adjustment surface 48 which is curved. The swivel adjustment surface 48 interfaces or mates with the swivel nozzle member 16 along the sealing line of contact 31. Preferably, the swivel adjustment surface 48 is a recessed surface. The curvatures of respective swivel adjustment surfaces 42, 48 differ from one another such that a gap 50 is formed between swivel adjustment surfaces 42, 48. As such, bore 32 remains in fluid communication with throughhole 46 and liquid discharge passageway 20 when bore 32 is oriented at a selected transverse angle.

Figure 3:
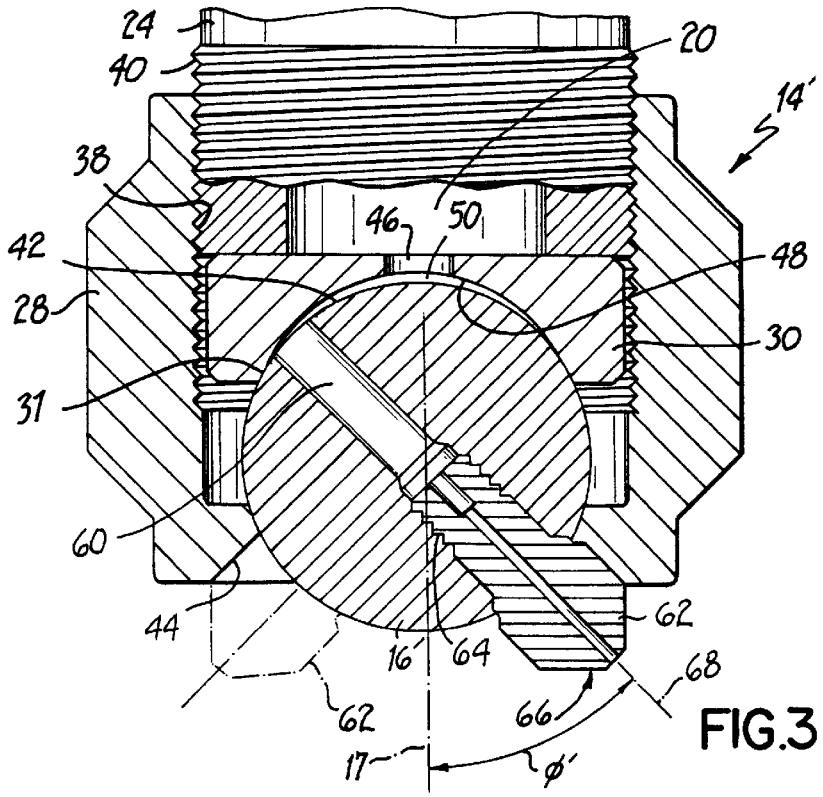
FIG. 3 is an enlarged partial cross-sectional view similar to FIG. 2 but showing another embodiment of the invention.

A nozzle 14' constructed according to another embodiment of the invention is illustrated in FIG. 3. Swivel nozzle member 16' has a bore 60 and a nozzle insert 62. Nozzle insert 62 is threaded, as opposed to being press fit, into a threaded portion 64 of swivel nozzle member 16'. As such, nozzle insert 62 can be readily removed from swivel nozzle member 16' so that it can be cleaned or replaced by another nozzle insert. Nozzle insert 62 has a end portion 66 which is configured to act as a stop against surrounding wall 44 of retaining member 28 to define the angular adjustment between predefined limits. A reference axis 68 is coaxially aligned with the bore 60 and the nozzle insert 62 and forms an angle $\phi'$ between the reference axis 68 and the longitudinal axis 17. For instance, discharge end 66 is preferably configured such that swivel nozzle member 16' rotates so $\phi'$ equals 45 degrees in multiple directions within the confines of surrounding wall 44 of retaining member 28.

Figure 4:
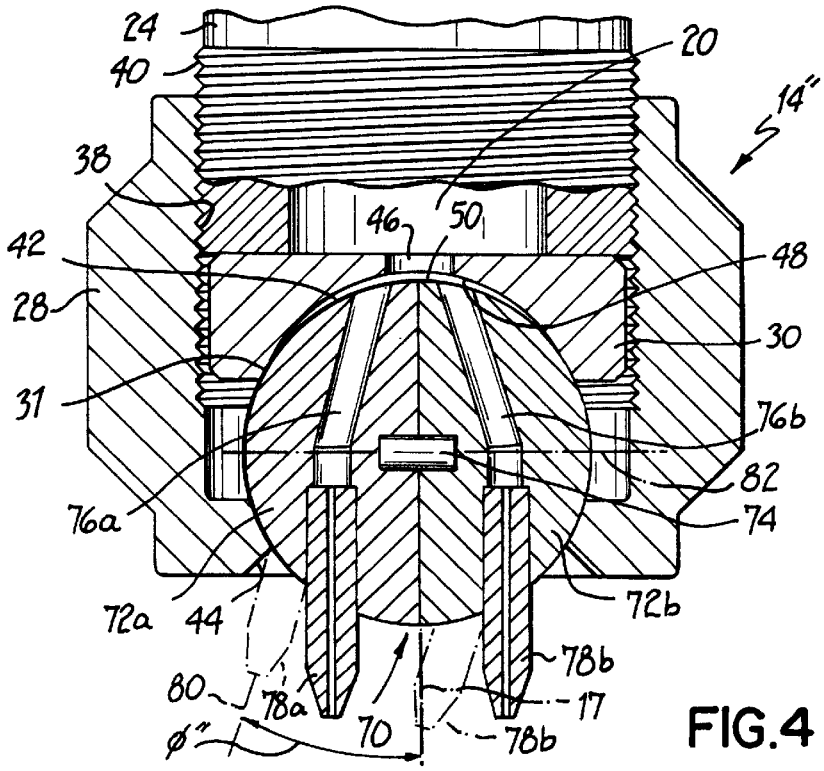
FIG. 4 is an enlarged partial cross-sectional view similar to FIGS. 2 and 3 but showing another embodiment of the invention.
Figure 5:
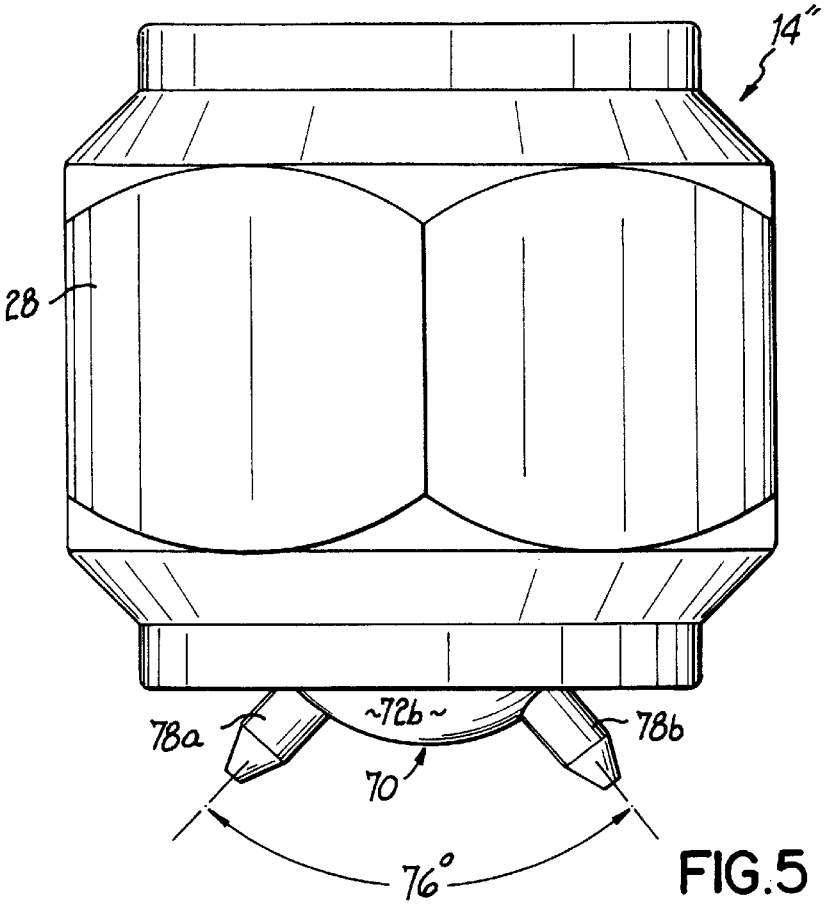
FIG. 5 is an elevational view of the swivel nozzle of FIG. 4.

Still another embodiment of the present invention is illustrated in FIGS. 4 and 5. In this regard, nozzle 14" has a swivel nozzle member 70 with first and second pieces or halves 72*a*, 72*b*. Halves 72*a*, 72*b* are pivotally connected with connecting pin 74. As such, each half 72*a*, 72*b* is pivotally adjustable about connecting pin 74 relative to the other. Each half 72*a*, 72*b* has a bore 76*a*, 76*b*, with a nozzle insert 78*a*, 78*b* press fit into each respective bore 76*a*, 76*b*. Swivel nozzle member 70 is configured such that bores 76*a*, 76*b* remain in fluid communication with dispenser body 12 when swivel nozzle member 70 is rotated to a desired angular position. Retaining member 28 is used to simultaneously lock halves 72*a*, 72*b* at the desired orientation. A reference axis 80 is coaxially aligned with nozzle insert 78*a* and forms and angle $\phi''$ with longitudinal axis 17. In this embodiment, angle $\phi''$ is defined as being equal zero when the reference axis 80 and the longitudinal axis 17 are parallel, but not coaxially aligned. Swivel nozzle member 70 can rotate a total of approximately 60 degrees about a reference axis 80 perpendicular to a longitudinal axis 82 of connecting pin 74. Additionally, bores 76*a*, 76*b* remain in fluid communication with dispenser body 12 when respective halves 72*a*, 72*b* are pivoted relative to one another. With specific reference to FIG. 5, each half 72*a*, 72*b* can pivot a total of approximately 76 degrees about connecting pin 74.

Figure 6:
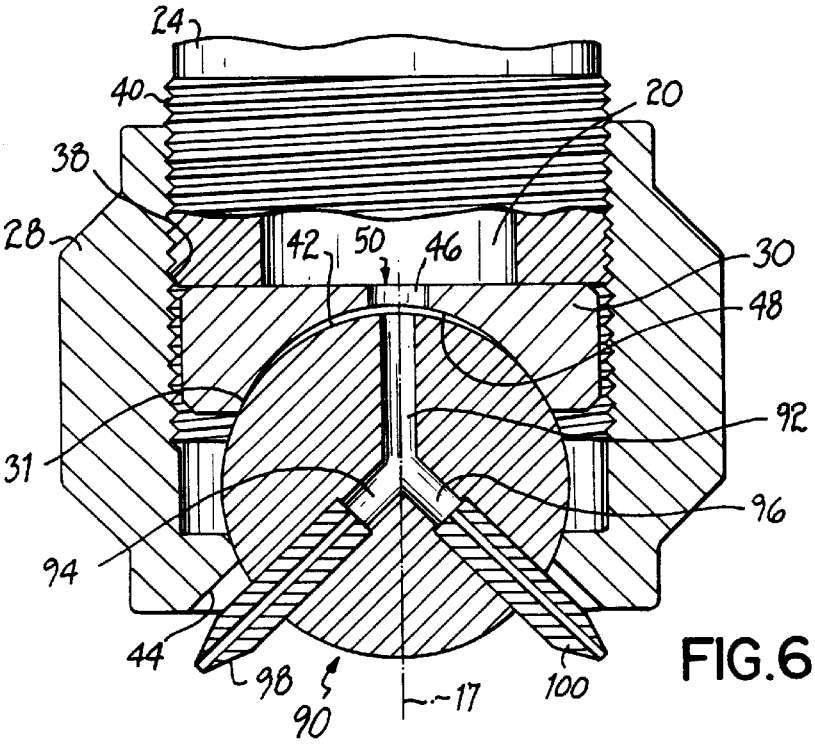
FIG. 6 is an enlarged partial cross-sectional view similar to FIGS. 2 and 3 but showing another embodiment of the invention.

It is contemplated that the one-piece swivel nozzle member 16 may further include multiple nozzle inserts. As shown in FIG. 6, for example, a swivel nozzle member 90 is illustrated with a main bore 92 having first and second dispensing bores 94, 96 which are at a fixed angle relative to each other. Like reference numerals in FIG. 6 represent like elements in the preceding embodiments. Inserted respectively within the first and second dispensing bores are first and second nozzle inserts 98, 100. The swivel nozzle member 90 is angularly adjustable such that the longitudinal axis of main bore 92 can be swivelled relative to the longitudinal axis 17 as described in connection with previous embodiments.

Referring again to FIGS. 1 and 2, swivel nozzle member 16 is initially retained against dispenser body 12 by retaining member 28 in an unlocked position that allows angular adjustment of bore 32 with respect to liquid discharge passageway 20 in multiple transverse directions. Swivel nozzle member 16 is moved to direct bore 32 at a desired transverse angular position relative to liquid discharge passageway 20. Finally, retaining member 28 is tightened to lock swivel nozzle member 16 at the desired transverse angular position such that swivel nozzle member 16 is prevented from further angular adjustment. The liquid enters dispenser body 12, flows through liquid discharge passageway 20, and exits from discharge end 24 of dispenser body 12. The liquid then passes into throughhole 46 of seal member 30 and into gap 50. From gap 50, the liquid enters bore 32 and exits through tip 36, regardless of the selected angular position of swivel nozzle member 16 relative to dispenser body 12. It will be appreciated that all embodiments of the invention described herein operate to dispense liquid in a similar manner, although differences exist relative to the structure of the nozzles as described above.

Swivel nozzle member 16 is generally free to swivel or rotate within the constraints of retaining member 28 with no preference for any particular angular position. However, at least one detent or other structure could be included in nozzles 14, 14' 14" to more easily and positively locate at least one preferred angular position for dispensing the liquid.

While the present invention has been illustrated by a description of various preferred embodiments and while these embodiments have been described in considerable detail in order to describe the best mode of practicing the invention, it is not the intention of applicant to restrict or in any way limit the scope of the appended claims to such detail. Additional advantages and modifications within the spirit and scope of the invention will readily appear to those skilled in the art. The invention itself should only be defined by the appended claims, wherein.

I claim:

1. A nozzle for dispensing adhesive or glue, the nozzle comprising:

a swivel nozzle member having a bore and a swivel adjustment surface;

a seal member having a throughhole and a swivel adjustment surface, said throughhole being adapted for fluid communication with a source of adhesive or glue; and a retaining member adapted for connection to said source of adhesive or glue for holding a portion of the swivel adjustment surface of said seal member against a portion of the swivel adjustment surface of said swivel nozzle member, the swivel nozzle member being movable for selective adjustment in an unlocked position to orient the bore of said swivel nozzle member at any one of a plurality of angles relative to the throughhole and being fixed against said selective adjustment in a locked position with the bore oriented at a selected one of a plurality of angles;

wherein the swivel adjustment surfaces have different curvatures to form a gap therebetween through which the adhesive or glue communicates between said throughhole and said bore at any one of said plurality of angles.

2. The nozzle of claim 1 wherein the respective swivel adjustment surfaces of said swivel nozzle member and said seal member are rounded to allow the transverse angular adjustment of the swivel nozzle member.

3. The nozzle of claim 2 wherein the swivel nozzle member is substantially spherical such that the swivel nozzle member is angularly adjustable over a predetermined range of angles with the center of the swivel nozzle member being a pivot point.

4. The nozzle of claim 1 wherein the swivel adjustment surface of said seal member is a recessed surface forming part of the gap such that the bore of the swivel nozzle member remains in fluid communication with the throughhole in said seal member when oriented at a selected one of said plurality of angles.

5. The nozzle of claim 1 wherein the swivel nozzle member has a plurality of bores in fluid communication with the throughhole of said seal member in order to dispense the adhesive or glue.

6. The nozzle of claim 5 wherein the swivel nozzle member further comprises a plurality of pivotally connected pieces, each piece having one of said bores and being angularly adjustable relative to the other piece.

7. The nozzle of claim 1 wherein the swivel nozzle member has a nozzle insert forming at least a portion of the bore, the nozzle insert having a discharge end acting as a stop against the retaining member to define the angular adjustment between predefined limits.

8. A method of angularly adjusting and securing a swivel nozzle member of a nozzle and a seal member to a dispenser body such that fluid communication is established between a bore of the swivel nozzle member, a gap between the seal member and the swivel nozzle member and a liquid discharge passageway of the dispenser body, the method comprising:

retaining the seal member and the swivel nozzle member against a dispenser body in an unlocked position that allows fluid communication between the liquid discharge passageway, the gap and the bore and angular adjustment of the bore with respect to the liquid discharge passageway over a plurality of angular positions, the gap remaining in fluid communication with the bore at any one of said plurality of angular positions;

moving the swivel nozzle member to direct the bore at a desired angular position relative to the liquid discharge passageway; and locking the swivel nozzle member at the desired angular position such that the swivel nozzle member is prevented from further angular adjustment.

9. The method of claim 8 wherein the swivel nozzle member includes a nozzle insert forming at least a portion of the bore, and the step of moving the swivel nozzle member further comprises:

moving the swivel nozzle member until the nozzle insert stops against another portion of the nozzle at a predefined limit.

10. The method of claim 8 wherein the swivel nozzle member has two pivotally connected pieces, each piece having a bore and being angularly adjustable relative to the other, and the step of moving the swivel nozzle member further comprises:

moving each of the two pivotally connected pieces relative each other to direct each respective bore at a desired angular position.

11. A nozzle for dispensing adhesive or glue, the nozzle comprising:

a swivel nozzle member having a bore and a swivel adjustment surface;

a seal member having a throughhole and a swivel adjustment surface, said throughhole being adapted for fluid communication with a source of adhesive or glue; and a retaining member adapted for connection to said source of adhesive or glue for holding a portion of the swivel adjustment surface of said seal member against a portion of the swivel adjustment surface of said swivel nozzle member, the swivel nozzle member being movable for selective adjustment in an unlocked position to orient the bore of said swivel nozzle member at any one of a plurality of angles relative to the throughhole and being fixed against said selective adjustment in a locked position with the bore oriented at a selected one of a plurality of angles;

wherein the swivel nozzle member has a nozzle insert forming at least a portion of the bore, the nozzle insert having a discharge end acting as a stop against the retaining member to define the angular adjustment between predefined limits.

* * * * *